United States Patent [19]

Finnern

[11] Patent Number: 4,562,932

[45] Date of Patent: Jan. 7, 1986

[54] CAP CLOSURE FOR A CONTAINER WITH PHARMACEUTICAL CONTENTS

[75] Inventor: Hartmut Finnern, Karlsruhe, Fed. Rep. of Germany

[73] Assignee: Franz Pohl Metall- und Kunststoffwarenfabrik GmbH, Karlsruhe, Fed. Rep. of Germany

[21] Appl. No.: 652,679

[22] Filed: Sep. 19, 1984

[30] Foreign Application Priority Data

Oct. 6, 1983 [DE] Fed. Rep. of Germany ..... 3336344

[51] Int. Cl.[4] ..... B65D 41/58

[52] U.S. Cl. ..... 215/249; 215/251; 215/255

[58] Field of Search ..... 215/249, 251, 253, 254, 215/255

[56] References Cited

U.S. PATENT DOCUMENTS 3,547,297 12/1970 Herbert et al. ..... 215/249

3,587,897 6/1971 Rohde ..... 215/249

FOREIGN PATENT DOCUMENTS 79539 5/1983 European Pat. Off. .

2628771 8/1980 Fed. Rep. of Germany .

2727737 7/1982 Fed. Rep. of Germany .

2101105 1/1983 United Kingdom .

*Primary Examiner*—Donald F. Norton

*Attorney, Agent, or Firm*—Wenderoth, Lind & Ponack

[57] ABSTRACT

A cap closure for containers with pharmaceutical contents, especially for bottle-shaped containers possessing tear-open tabs and containing substances destined for injection, infusion or transfusion, is constructed such that a stopper can be pulled from the container without contaminating the sterile pouring rim thereof. A lifting-off part provided on the closing cap is intended to engage with the stopper. The tear-open tab and a grip piece form a pulling element for lifting off the stopper on which the lifting-off part acts.

11 Claims, 3 Drawing Figures

CAP CLOSURE FOR A CONTAINER WITH PHARMACEUTICAL CONTENTS

BACKGROUND OF THE INVENTION

The present invention relates to a closure cap for a container with pharmaceutical contents, especially for bottle-shaped containers containing substances destined for injection, infusion, or transfusion where the container neck is closed by a stopper, over which a closure cap fits, an edge portion of this stopper resting on the upper rim surface of the container neck, while a closing cap possesses a tear-open tab for opening the closure cap, this tab being provided with a grip piece and being prepared for opening by means of a tearing line.

STATE OF THE PRIOR ART

In the case of containers with pharmaceutical contents, it is necessary to impose exacting requirements with regard to the sterility of the closure during storage and use.

Cap closures are known, in which a metal closing cap fits over the rubber-elastic bottle-neck stopper, a beaded-over edge of this cap bearing against a corresponding shoulder of the container neck. A tear-open tab is located in the cover surface of the metallic closing cap and this tab can be pulled out with the aid of a grip piece in the form of a ring tab. A cap closure of this type as disclosed in German Patent No. 27 27 737 can be used in two ways. If merely the central part is pulled out, the surface of the stopper is exposed and can, for example, be pierced with a hypodermic needle. Pulling the tear-open tab out further, beyond the edge of the closing cap, enables the latter to be detached completely, thus enabling the stopper to be pulled out in order to decant the contents of the container.

Another embodiment of a closure cap which can be used both for piercing the stoppper and for extracting it completely is described in German Patent No. 26 28 771.

In the case of these completely detachable closure caps, there is the danger of pathogenic contamination of the container contents when the fingers are used to grip the stopper at its edge and to pull it out. This can cause bacterial contamination of the container rim, and corresponding contamination of the container contents is possible while they are being decanted across this non-sterile region, created during the opening operation.

Published European Patent Application No. 00 79 539 and United Kingdom Patent Application No. 21 021 105 describe a cap closure for a container with pharmaceutical contents. In this closure a grip piece projecting upwards in the shape of a cylinder is integrally formed on the metal closing cap which fits over the stopper. When the grip piece is tilted laterally, the edge of the closing cap engages beneath the edge of the stopper, thus enabling the stopper and the closing cap to be taken off together. Thereby contamination of the stopper by the sensing fingers is avoided. But the upward-projecting cylindrical grip piece necessitates extra space in the container packaging and, in addition, does not allow any choice of the way in which the cap closure could be used. This cap closure could be used only by the complete detachment of the closing cap.

SUMMARY OF THE INVENTION

Accordingly it is an object of the present invention to improve a cap closure of the type described in the introduction in a manner whereby it can be used with the stopper securely held and with the stopper completely detached without any danger of non-sterile contamination of the pouring rim on the container neck occuring during the detachment operation. A further object of the invention is that it should be possible to manufacture the cap closure cheaply as a mass-produced article requiring only a modest expenditure for material, and further that this closure should permit the sealed containers to be packaged in a compact arrangement requiring only a small amount of space.

These objects are achieved in accordance with the present invention by a lifting-off part provided on the closing cap, this lifting-off part being intended to engage with the stopper, and in that the tear-open tab and the grip piece form a pulling element for lifting-off the stopper on which the lifting-off part acts.

An improved embodiment can include the provision of a claw-shaped lifting-off part at a lower beaded-over edge of the closing cap, this lifting-off part lying between two laterally-located cutouts in the beaded-over edge and engaging beneath the edge portion of the stopper during the opening operation.

In use, a cap closure of this design offers the important advantage that while the closing cap is being removed completely and the stopper is being pulled out, the positions of the user's hands are fixed in a manner such that they do not come into contact with the edge portion of the stopper and the pouring rim of the container neck. In consequence, the rim of the container remains completely sterile. When the tear-open tab is partially torn off, a cap closure of this design can also be used for piercing with a hypodermic needle or similar device in a known manner, the stopper being held perfectly by the closing cap which remains fixed.

In a further embodiment of the invention it can be useful if the tear-open tab extends into the region of the upper edge of the closing cap, and in some cases if it extends beyond this edge, towards the cylindrical peripheral surface. Moreover, it appears to be advantageous when the claw-shaped lifting-off part lies beneath that edge region of the closing cap into which the tear-open tab extends.

If desired, a further advantage can be obtained by adopting a design wherein the tear-open tab is bounded by a prepared tearing line which is leak-proof until the opening operation is performed. In this way a completely metallic leakproof closure cap is provided. In another embodiment which may be advantageous under some circumstances, the tear-open tab can be retained by bridges of material which remain in an open tearing line and which act as holding bridges. These holding bridges are broken during the operation of opening the cap closure, that is to say during the process of bending-over the grip piece.

An improved embodiment can adopt an arrangement wherein the tear-open tab possesses an eye which is located symmetrically with respect to the center of the cap, and into which a projection on the inner surface of the disc-shaped grip piece engages, forming a first inner sealing area. In order to provide a substantial degree of sealing against germ ingress, this sealing area should be configured as a continuous annulus and should not be made too small.

It can be advantageous, furthermore, to form a second outer sealing area between the inner surface of the disc-shaped grip piece and the surface of the closing cap. In this case, too, the aim is to provide a continuous, annular sealing area which if possible, is uninterrupted by additional apertures.

It appears to be advantageous for perfect functioning of the cap closure if a cutout is provided at a lower beaded-over edge on each side of the claw-shaped lifting-off part, these cutouts lying above a central line of symmetry, facing towards the lifting-off part. A construction of this nature results in adequate retention of the closing cap during a sterilisation process, while still enabling the cap closure to be pulled off by applying only a small force.

In a further embodiment of the invention, it can be advantageous if at least one direction-marking element is located on the upper surface of the tear-open tab, and/or on the cover surface of the closing cap, this element pointing towards that region of the edge portion of the disc-shaped grip piece at which the opening operation should be started by bending over, and if the disc-shaped grip piece is formed from a transparent or translucent material. For perfect functioning during the release of the cap closure it is expedient for the lifting of the disc-shaped grip piece to begin in this region. The application of a direction-marking to the tear-open tab or, as the case may be, to the remaining cover surface of the closing cap demands that the disc-shaped grip piece be made from a transparent material, or if appropriate, from one which is translucent, so that the direction-marking element can stil be seen through the grip piece. The application of direction-marking elements to the grip piece is in practice less advantageous since in this case it would be necessary to ensure that the grip piece is located in a defined position relative to the closing cap. In general this is possible only at considerable expense, owing to the fact that the components possess rotational symmetry.

Furthermore, it could be important if the disc-shaped grip piece is designed in the shape of a dinner plate, possessing a rim portion which fits over the upper outer edge of the closing cap. This design extends the second outer sealing area and improves its sealing action.

Moreover, it can be advantageous if the closing cap is composed of metal and if the disc-shaped grip piece is composed of a plastic material which is essentially rigid.

The features of the invention provide a cap closure which is usable both in a partly-detachable mode (exposure of an area of the stopper) and in a fully-detachable mode (extraction of the stopper). When used in either way, the sterility of the corresponding surfaces of the stopper, of the neck of the bottle and of its contents is guaranteed.

BRIEF DESCRIPTION OF THE DRAWINGS

Other objects, features and advantages of the present invention will be apparent from the following detailed description of a preferred embodiment thereof, with reference to the accompanied drawings wherein.

DETAILED DESCRIPTION OF THE INVENTION

Figure 1:
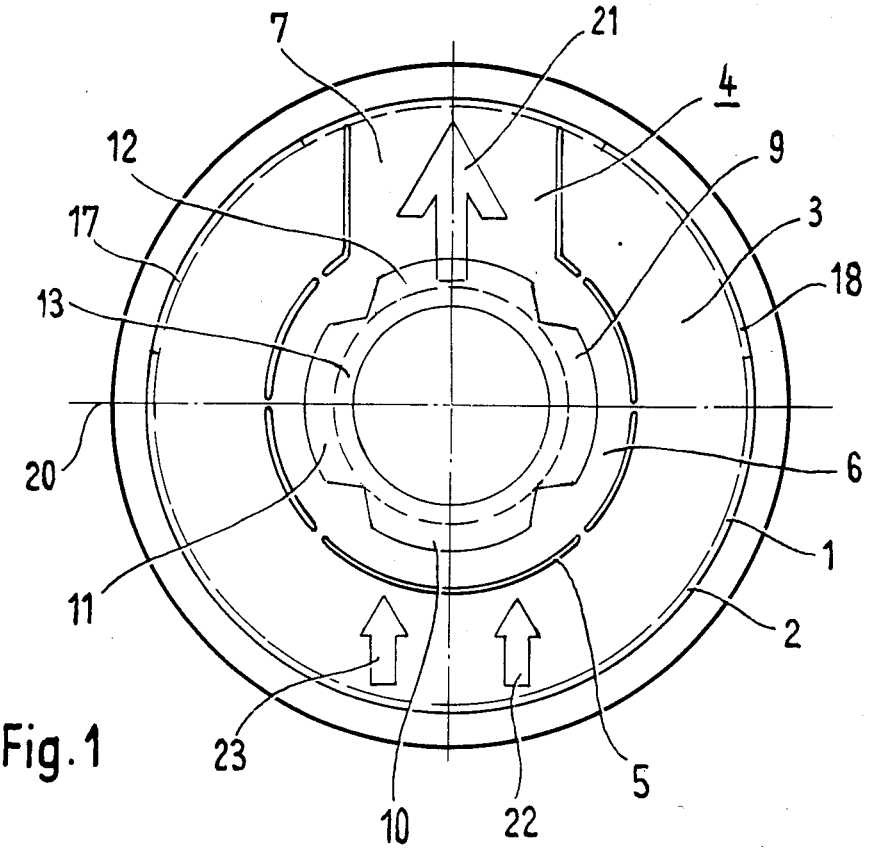
FIG. 1 is a plan view of a closure cap according to the invention.
Figure 2:
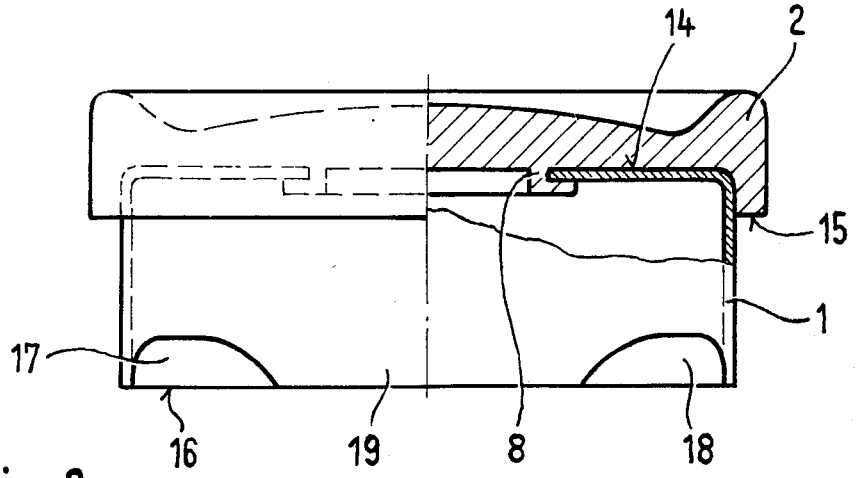
FIG. 2 is a partially sectioned side view of the closure cap shown in FIG. 1.

FIGS. 1 and 2 depict an aluminum closing cap 1, the thickness of the aluminum being 0.3 mm. A grip piece 2, shaped like a dinner plate, fits over the top of this closing cap 1. A tear-open tab 4 is defined by a tearing line 5 in the cover surface 3 of the closing cap 1, this tab 4 comprising an eye 6 and a tongue portion 7, the latter extending into the edge region of the closing cap 1. A projection 8 forming part of the grip piece 2 engages into the eye 6, this projection 8 overlapping the central aperture of the closing cap 1 on the inside and forming a first inner sealing area 13 at the continuous inner edge, between four retaining tongues 9,10,11 and 12.

A second outer sealing area 14 which is also continuous lies between the inner surface of the plate-shaped grip piece 2 and the cover surface of the closing cap 1. The second sealing area 14 is enlarged by a downward-extended rim 15 of the plate-shaped grip piece 2.

A lifting-off part 19 is formed at the lower edge 16 of the closing cap 1 between two laterally-located cutouts 17,18 (FIG. 2), this lifting-off part 19 bearing in the form of a claw or a hook against a corresponding portion of the rim of the neck of the bottle once the cap closure has been fitted, that is to say once the lower edge 16 has been beaded-over.

The cutouts 17 and 18 which are fashioned on either side of the lifting-off part 19 lie to one side of a central line 20 of symmetry and face towards the lifting-off part 19 (FIG. 1).

Arrows 21, 22 and 23 are impressed into the upper surface of the tear-open tab 4, or, if appropriate, into the remaining cover surface 3 of the closing cap 1, as direction-marking elements. Since the plate-shaped grip piece 2 is manufactured from a transparent material, or, if appropriate, from one which is translucent (preferably polypropylene), these direction-marking arrows can readily be recognised even when the grip piece 2 is in place. They define the edge region marked in FIG. 1 by the direction of the arrows 21,22 and 23, at which a finger should be placed in order to lift off the grip piece 2, and hence to open the cap closure.

Figure 3:
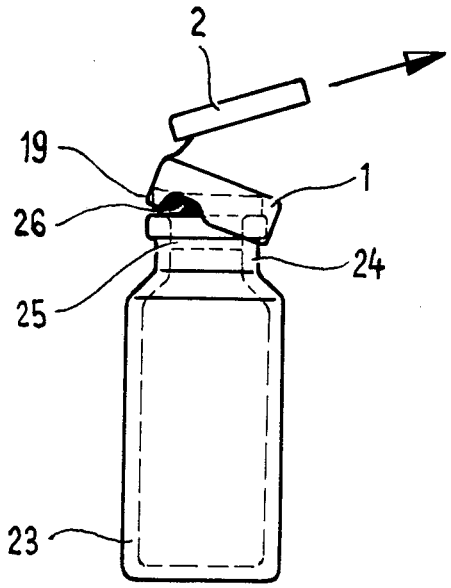
FIG. 3 is an elevation view of a cap closure of the embodiment according to FIGS. 1 and 2, fitted to a bottle intended for injection solutions during the opening operation.

The operation of opening the cap closure is explained by FIG. 3, which shows an intermediate position. A rubber-elastic stopper 25 is employed to close a bottle 23, this stopper 25 being inserted into the neck 24. The stopper 25 possesses an edge portion 26, under which the claw-shaped lifting-off part 19 has already engaged, and as the grip piece 2 is pulled off further, the closing cap 1 is levered-off at one side by means of the tear-open tab 4 in a manner such that the action of the claw-shaped lifting-off part 19 also causes the stopper 25 to be pulled from the neck 24 at the same time as the closing cap 1 is removed completely.

The operation of opening the cap closure is performed by two manual actions. The grip piece 2 is first gripped and slightly raised in the rim region designated by the direction-marking elements, this action causing the tear-open tab 4 to be pulled out of the cover surface 3 of the closing cap 1. In this opening position the cap closure could already be used for hypodermic needles and similar devices, the surface of the stopper being exposed as a result of the partial detachment of the closure.

In order to remove the cap closure completely, and to pull out the stopper, the grip piece 2 must be pulled off laterally in the direction shown by the arrow in FIG.

3. During this action the tear-open tab 4 and the grip piece 2 form a pulling element.

I claim:

1. In a cap closure for a container with pharmaceutical contents, especially for bottle-shaped containers containing substances destined for injection, infusion or transfusion and having a container neck closed by a stopper with an edge portion resting on an upper rim surface of the container neck, said cap closure being of the type including a closing cap fitting over the stopper and having a tear-open tab for opening the cap closure, said tab being defined by a tearing line, and a grip piece attached to said tab for tearing said tearing line and removing said closing cap, the improvement wherein:

said closing cap includes a lifting-off part for engaging with the stopper; and said tear-open tab and said grip piece together form a pulling element for removing the stopper from the container neck by said engagement thereby of said lifting off part.

2. The improvement claimed in claim 1, wherein said lifting-off part is hook-shaped and is formed by a beaded-over lower edge of said closing cap, said lifting-off part lying between and being defined by two laterally-located cutouts formed in said beaded-over edge, and said lifting-off part engaging beneath an edge portion of the stopper.

3. The improvement claimed in claim 1, wherein said tear-open tab extends into the region of the upper edge of said closing cap.

4. The improvement claimed in claim 1, wherein said lifting-off part is located beneath an edge region of said closing cap toward which said tear-open tab extends.

5. The improvement claimed in claim 1, wherein said tear-open tab is bounded by a prepared leakproof tearing line.

6. The improvement claimed in claim 1, wherein said tear-open tab is retained by bridges of the material of said closing cap separated by open tearing lines.

7. The improvement claimed in claim 1, wherein said tear-open tab includes a central eye portion located symmetrically with respect to the center of said closing cap, and said grip piece is disc-shaped and includes a projection extending into said disc-shaped grip piece and engaging with an inner surface thereof to define a first inner sealing area.

8. The improvement claimed in claim 7, further comprising a second outer sealing area formed between the inner surface of the disc-shaped grip piece and a surface of said closing cap.

9. The improvement claimed in claim 1, further comprising at least one direction-marking element located on the upper surface of said closing cap and indicating a region of the edge portion of said grip piece at which an operation of tearing said tear line should be initiated, and wherein said grip piece is formed of a transparent material.

10. The improvement claimed in claim 1, wherein said grip piece is designed in the shape of a dinner plate and has a rim portion which fits over the upper edge of said closing cap.

11. The improvement claimed in claim 1, wherein said closing cap is formed of metal and said grip piece is formed of plastic material.

* * * * *